US012808626B2

(12) United States Patent
Wood et al.

(10) Patent No.: US 12,808,626 B2
(45) Date of Patent: Nov. 24, 2026

(54) GAS PROJECTILE PLATFORM SAFETY FEATURE

(71) Applicant: War Machine, Inc., Taylors, SC (US)

(72) Inventors: Michael Wood, Taylors, SC (US); Chris Vandenberghe, Taylors, SC (US)

(73) Assignee: War Machine, Inc., Taylors, SC (US)

( * ) Notice: Subject to any disclaimer, the term of this patent is extended or adjusted under 35 U.S.C. 154(b) by 0 days.

(21) Appl. No.: 19/171,317

(22) Filed: Apr. 6, 2025

(65) Prior Publication Data

US 2025/0321076 A1 Oct. 16, 2025

Related U.S. Application Data

(60) Provisional application No. 63/632,479, filed on Apr. 10, 2024, provisional application No. 63/632,196, filed on Apr. 10, 2024.

(51) Int. Cl.

*F41B 11/721* (2013.01)
*F41B 11/70* (2013.01)
*F41B 11/80* (2013.01)

(52) U.S. Cl.

CPC ..... *F41B 11/70* (2013.01); *F41B 11/80* (2013.01)

(58) Field of Classification Search

CPC ..... F41A 33/06; F41A 11/00; F41B 11/723; F41B 11/72; F41B 11/70; F41B 11/80; F41B 11/721

USPC ..... 124/73, 31, 56, 77, 71, 76

See application file for complete search history.

(56) References Cited

U.S. PATENT DOCUMENTS

| | | | | |
|---|---|---|---|---|
| 10,408,556 | B2 * | 9/2019 | Dottle | F41A 33/06 |
| 12,422,055 | B2 * | 9/2025 | Wood | F16K 31/16 |
| 2006/0027221 | A1 * | 2/2006 | Farrell | F41B 11/723 124/31 |
| 2018/0149443 | A1 * | 5/2018 | Dottle | F41A 33/02 |
| 2019/0257612 | A1 * | 8/2019 | Gardner, Jr. | F41B 11/723 |
| 2020/0088489 | A1 * | 3/2020 | Dottle | F41A 33/06 |
| 2025/0321076 | A1 * | 10/2025 | Wood | F41B 11/80 |

* cited by examiner

*Primary Examiner* — Michael D David

(74) *Attorney, Agent, or Firm* — Kim and Lahey Law Firm, LLC; Douglas W. Kim

(57) ABSTRACT

A paintball gun includes a frame, an operating assembly at least partially slidably received within the frame and having a locking pin receptacle, and a locking pin within the frame having two positions. In a break down position, the locking pin is received entirely within the frame and the operating assembly can freely slide in or out of the frame. In a firing position, the locking pin extends partially from the frame into the locking pin receptacle within the operating assembly, preventing the operating assembly from coming out of the frame. The paintball gun may include a spring biasing the locking pin in the break down position and a pressurized gas system that transitions the locking pin to the firing position when pressurized gas is introduced.

20 Claims, 2 Drawing Sheets

GAS PROJECTILE PLATFORM SAFETY FEATURE

RELATED APPLICATIONS

This application claims priority to U.S. Provisional Patent Applications 63/632,196 filed Apr. 10, 2024 and 63/632,479 filed Apr. 10, 2024 both of which are incorporated by reference.

BACKGROUND

1) Field of the Invention

This system is directed to the action and assembly for a compressed gas gun, including a paintball gun.

2) Description of the Related Art

Gas powered guns, including paintball guns that can be used in paintball activities typically use compressed gas for firing projectiles. Generally, these guns are known, but disassembly and assembly can be challenging in the field or for inexperienced users. Such in field servicing is commonly needed when the action becomes fouled and will not function such as by the bursting of paint balls within the action or the inadvertent dirt or grime. Typical means of easing disassembly fall short in strength and safety. A need exists for an easy to disassemble and reassemble design that is also safe.

In some cases, disassembly may be needed in the field for reasons such as when the paintball gun experiences a malfunction. For example, paint balls may break inside the gun's barrel or breach, causing a buildup of paint residue that interferes with proper operation. Dirt, debris, or moisture may also enter the gun's mechanisms during play, potentially causing jams or misfires. Additionally, O-rings or seals may wear out or become damaged, leading to gas leaks or reduced efficiency. Quick field disassembly allows users to clean internal components, clear obstructions, replace worn parts, or perform basic maintenance to restore proper function and continue play. The ability to easily disassemble and reassemble the gun without specialized tools may also facilitate routine cleaning and maintenance between games or at the end of a day of play.

While quick disassembly is desired for maintenance and cleaning purposes, it is important that the components of the gas projectile platform remain securely assembled during operation. This is particularly desirable when the assembly is under pressure from compressed gas. In some respects, the design may incorporate features that allow for easy disassembly when intended but prevent unintended separation of components during use.

Therefore, it is an objective of this system to provide a quick disassembling action and procedure without the need for tools and capable of reassembly in the field.

It is another objection of the present system to securely connect the operating assembly with frame when the system is in operation and especially when pressurized.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

The above objectives are accomplished by providing a gas gun projectile platform including an operating assembly lock having a frame, an operating assembly at least partially slidably received in the frame, and a locking pin received in the frame in a biased inward position configured to travel outward into a receptacle in the operating assembly when activated whereby the locking pin affixes the operating assembly within the frame. The locking pin is connected to a locking pin piston within a locking pin cylinder and is activated by applying a pressurized fluid to the locking pin cylinder to exert an outward force upon the locking pin through movement of the locking pin piston within the locking pin cylinder. The locking pin piston, when in the biased inward position, prevents the gas gun projectile platform from functioning by preventing the flow of air to the firing mechanisms of the platform.

The assembly may include locking mechanisms that engage when the system is pressurized, ensuring that critical components stay in place during firing. These mechanisms may disengage when the pressure is released, facilitating disassembly. In some cases, the locking mechanisms may be designed to withstand the forces generated during repeated firing cycles while still allowing for tool-free disassembly when needed.

Additionally, the assembly may incorporate seals and gaskets that not only prevent gas leakage but also contribute to holding components together under pressure. These seals may be designed to maintain their integrity during operation while allowing for easy separation when the system is depressurized.

In some implementations, the design may include safety features that prevent disassembly attempts while the system is pressurized, reducing the risk of accidental separation during use. These safety features may be integrated into the locking mechanisms or may be separate components that indicate when it is safe to disassemble the platform.

The foregoing general description of the illustrative embodiments and the following detailed description thereof are merely exemplary aspects of the teachings of this disclosure and are not restrictive.

BRIEF DESCRIPTION OF FIGURES

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION

The following description sets forth exemplary aspects of the present disclosure. It should be recognized, however, that such a description is not intended as a limitation on the scope of the present disclosure. Rather, the description also encompasses combinations and modifications to those exemplary aspects described herein.

Figure 1:
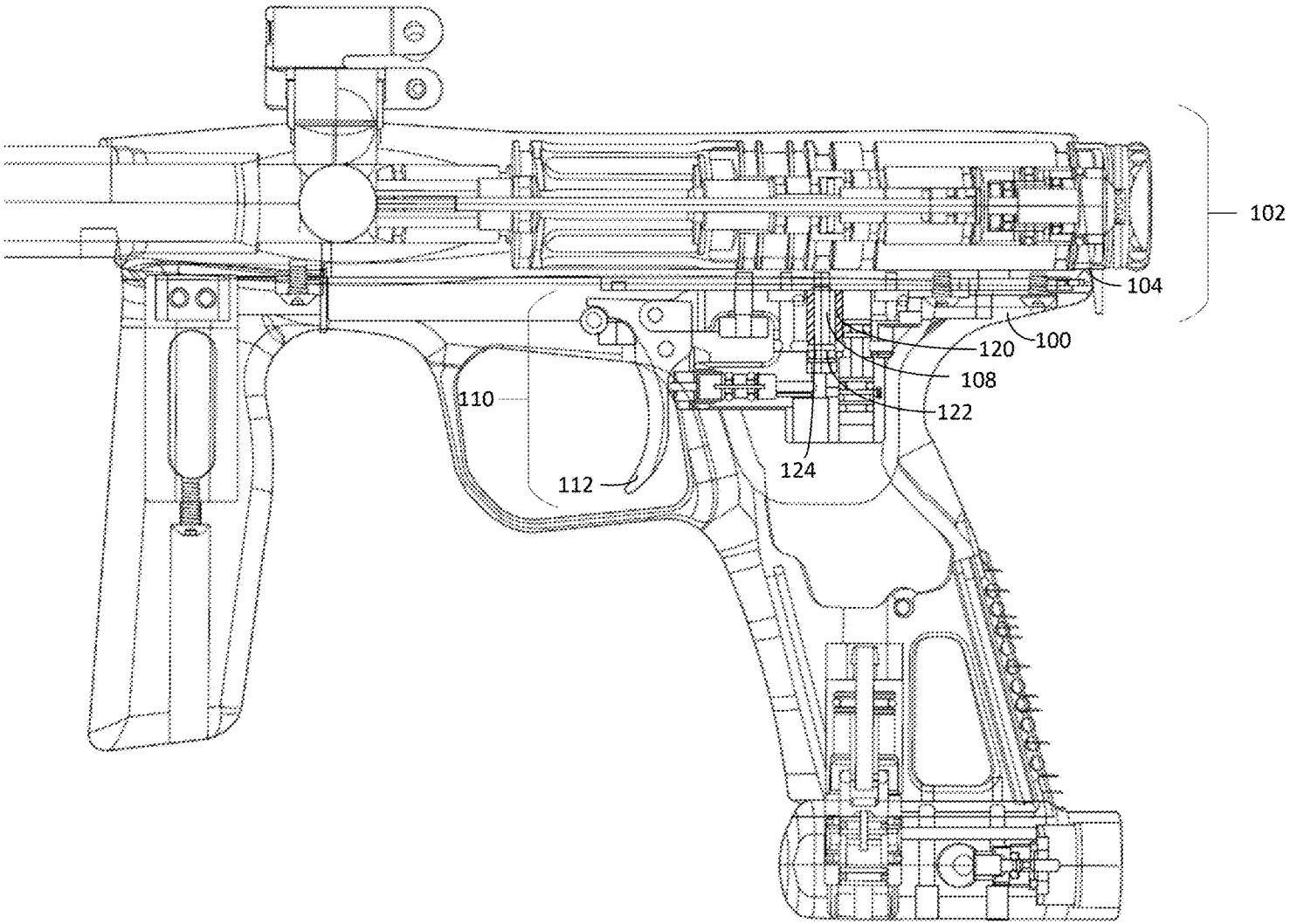
FIG. 1 is a cut away view of an assembled compressed gas gun according to the invention.

Referring to FIG. 1, a frame 100 is shown housing an operating assembly 102. The shown embodiment is a paint ball gun but could as easily be any pressurized gas system.

The operating assembly 102 is inserted into the frame 100 through rear operating assembly port 104. The action can feature a stop, such as a ridge or ledge, located near the rear, to catch on the outer edge of operating assembly port 104 when the operating assembly 102 is fully inserted into the frame 104. In another embodiment, the operating assembly 102 may seat fully against the frame 100 and internals therein without need for any ridge or ledge. In the embodiment shown, the operating assembly 102 is cylindrical in nature, however the operating assembly 102 could be any configuration slidably insertable into the frame 100.

Operating assembly 102 features locking pin receptacle 106. Locking pin receptacle 106 is configured to accept locking pin 108 when the locking pin 108 is in the outward position. Locking pin 108 is biased inward by spring 120 which exerts pressure on locking pin piston 122 and against frame 100. In the uninfluenced state, locking pin 108 resides within trigger assembly 110 and does not extrude into frame 100.

When locking pin 108 is in the inward position, operating assembly 102 can be slidably inserted or removed from frame 100. Extraction of operating assembly 102 from frame 100 can be accomplished by gripping the rear of operating assembly 102 protruding outward of operating assembly port 104 and pulling rearward. Insertion of operating assembly 102 is accomplished in the reverse manner and is complete when operating assembly 102 is fully seated in frame 100. In the embodiment shown, the operating assembly 102 is a symmetrical cylinder which allows the operating assembly 102 to be oriented in any direction along its axis. When the operating assembly 102 is inserted in the frame 100, the locking pin receptacle 106 is operatively located adjacent to the locking pin 108 such that the locking pin receptacle 106 can receive locking pin 108. In the shown embodiment, the locking pin receptacle 106 is a groove circumnavigating the diameter of the operating assembly 102.

Frame 100 holds trigger valve assembly 110. The trigger assembly comprises a trigger, a series of pistons, locking pin cylinder 124 containing locking pin piston 122 connected to locking pin 108, spring 120, and a series of chambers and valves to control and direct the flow of gas from an air cannister to the action within operating assembly 102. Trigger assembly 110 is configured to fit within the frame and is affixed within frame through screws, latches, pins or other such means. Locking pin 108 is attached to locking pin piston 122, which rides in locking pin cylinder 124, and which together is used to control the position of locking pin 108 within the trigger valve assembly 110.

In the trigger valve assembly 110, the locking pin 108 is biased inward within the trigger valve assembly 110 by spring 120 which exerts pressure on both the frame 100 (or the upper portion of the trigger valve assembly 110) and locking pin piston 122 forcing the locking pin piston 122 into the inward position in locking pin cylinder 124. In the biased position, the locking pin piston 122 prevents the flow of pressurized gas through the trigger valve assembly and to the operating assembly 102.

When pressurized gas, such as carbon dioxide, is added to pressurize the system, the gas flows into the trigger valve assembly 110 through internal ports and exerts pressure on the locking pin piston 122 pushing the locking pin piston 122 upward within the locking pin cylinder 124. When the locking pin piston 122 is pushed upward within locking pin cylinder 124, locking pin 108 is pushed out of the trigger valve assembly 110 and into locking pin receptacle 106. When the locking pin 108 is fully seated in locking pin receptacle 106, ports within the trigger valve assembly 110 and the locking pin piston 122 are aligned into an operative connection which allows the pressurized gas to flow through the trigger valve assembly 110 and into the operating assembly 102. These gas flow through ports only operate when the locking pin is fully engaged within the locking pin receptacle. Such flow of pressurized gas may be further controlled by the trigger 112 and other pistons and valves in the trigger valve assembly 110. The system may be separated from the source of pressurized gas by a simple valve that allows the user to turn the pressurized gas on, off, or to set the allowable flow of pressurized gas.

When the system is successfully pressurized, the locking pin 108 will seat into locking pin receptacle 106. This allows the user to function the paintball gun as normal and holds the operating assembly safely in the frame. If the locking pin 108 cannot seat into locking pin receptacle 106, such as through incorrect seating of the operating assembly 102 in frame 100 or because of some obstruction in locking pin receptacle 106, the locking pin piston 122 will prevent the flow of pressurized gas through the trigger valve assembly preventing the paintball gun from functioning. The gas flow through ports are blocked acting as a safety which prevents use of the paintball gun when not properly assembled.

Locking Pin 108 and locking pin piston 122 acts as both a means to affix the operating assembly 102 within the frame 100 and to prevent the function of the system when not properly seated. If locking pin 108 is not fully moved into the outward position, i.e. filling receptacle 106, then locking pin piton 122 continues to block the flow of pressurized gas through trigger valve assembly 110 and into the operating assembly 102. Unless the operating assembly 102 is secured within the frame 100 by locking pin 108 seated in locking pin receptacle 106, the trigger valve assembly 110 will not allow gas to flow into the operating assembly 102.

Figure 2:
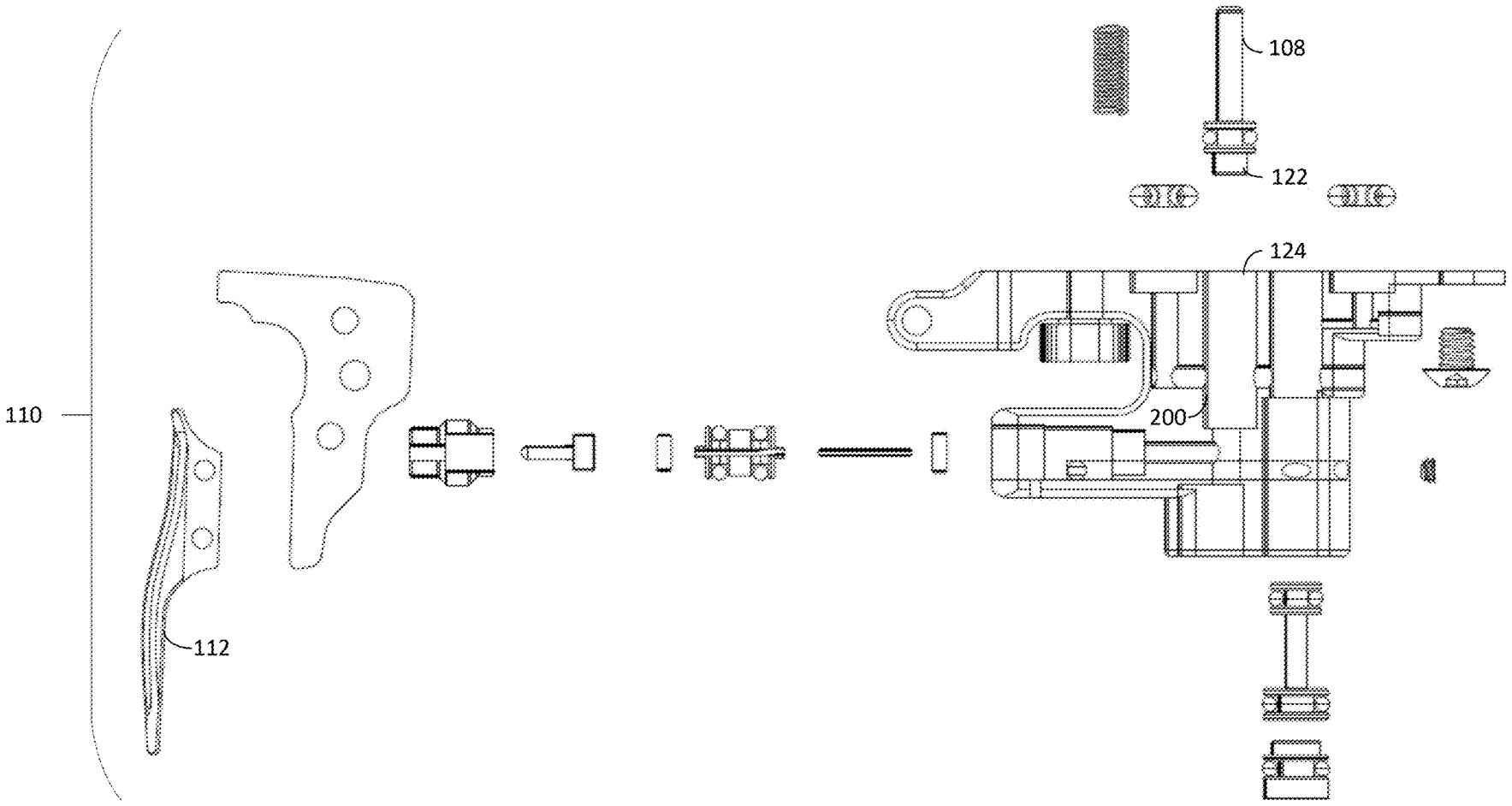
FIG. 2 is a cut away partial view of an assembled compressed gas gun according to the invention.

Referring to FIG. 2, the trigger assembly 110 is shown in an exploded view. Trigger 112 is shown along with the triggering valve contained with then assembly. Locking pin 108 is shown integrally formed to locking pin piston 122. Locking pin piston 122 fits within locking pin cylinder 124. A spring 120 fits over locking pin 108, onto the top of locking pin piston 122, and presses against the frame 100 show in in FIG. 1. Such configuration will bias locking pin 108 and locking pin piston 122 in the retracted (downward) position until pressure is exerted on locking pin piston 122 by pressurized gas entering locking pin cylinder 124 from an inlet port 200 at or towards the bottom of the cylinder. If locking pin 108, and by extension locking pin piston 122, is prevented from moving upward, such as by incorrect seating of the operating assembly in the frame, the locking pin piston will prevent pressurized gas from flowing through the locking pin cylinder and into the action of the gas projectile platform.

The assembly can also be used for other applications where easy disassembly and reassembly is desired in a pressurized gas operated action. The assembly described herein can be a weapon platform such as a paint ball action for a pistol or rifle, pellet gun or BB gun. The assembly described herein can be used for tools such as nail gun, rivet driver and other applications using impact or compression force for operation and construction.

The operating assembly may be designed to remain securely in place within the frame when the system is pressurized for several reasons. When pressurized gas is introduced to the system, it may create forces that are not desirable to be released without firing. The locking pin, when extended into the locking pin receptacle under pressure, may provide a robust mechanical connection between the frame and operating assembly. This connection may help withstand the internal pressures and forces generated during firing cycles.

In some implementations, the locking pin is a safety feature that actively prevent removal of the operating assembly when pressurized. This feature may include mechanisms that physically block disassembly attempts or indicators that signal when it is unsafe to separate components. Such design elements may help prevent accidental depressurization or injury that could result from attempting to remove the operating assembly while the system is still under pressure.

The retention of the operating assembly within the frame during pressurized operation may also be important for maintaining proper timing and function of the firing mechanism and prevent loss of pressure. Secure positioning of the operating assembly may ensure that internal components remain correctly aligned for reliable and consistent performance throughout multiple firing cycles.

It is understood that the above descriptions and illustrations are intended to be illustrative and not restrictive. It is to be understood that changes and variations may be made without departing from the spirit or scope of the following claims. Other embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A paintball gun system comprising:
a frame;
a trigger valve assembly within the frame;
an operating assembly at least partially slidably received into the frame and having a locking pin receptacle; and
a locking pin within the frame having a retracted position wherein the locking pin is received entirely within the frame and the operating assembly can freely slide in or out of the frame, and a firing position wherein the locking pin extends from the frame into the locking pin receptacle within the operating assembly, preventing the operating assembly from being removed from the frame; and
a locking pin piston included in the locking pin, wherein the locking pin piston, when in the retracted position, prevents the flow of pressurized gas through the trigger valve assembly to the operating assembly.

2. The paintball gun system of claim 1, further comprising a spring biasing the locking pin into the frame.

3. The paintball gun system of claim 2, further comprising:
a locking pin piston included in the locking pin;
a locking pin cylinder within the frame which receives the locking pin piston; and
a pressurized gas system in fluid communication with the locking pin cylinder.

4. The paintball gun system of claim 3, wherein the pressurized gas system is configured to transition the locking pin from the retracted position to the firing position when a pressurized gas is introduced to the pressurized gas system by applying pressure to the locking pin piston.

5. The paintball gun system of claim 4, wherein the locking pin piston prevents the operating assembly from removal from the frame when in the firing position.

6. The paintball gun system of claim 1, wherein the locking pin receptacle comprises a circumferential groove extending around an outer surface of the operating assembly.

7. The paintball gun system of claim 1, wherein the operating assembly is configured to be inserted into the frame through a rear operating assembly port.

8. A frame assembly for a paintball gun comprising:
a frame;
a trigger valve assembly within the frame; and
a locking pin received in the frame, the locking pin having a biased inward position configured to travel outward into a receptacle in an operating assembly when pressurized gas is introduced to the frame, whereby the locking pin is adapted to be received into the operating assembly to secure the operating assembly to the frame; and
a locking pin piston included in the locking pin, wherein the locking pin piston, when in the biased inward position, prevents the flow of pressurized gas through the trigger valve assembly to the operating assembly.

9. The frame assembly of claim 8, further comprising a spring biasing the locking pin towards the inward position.

10. The frame assembly of claim 9, further comprising:
a locking pin piston attached to the locking pin; and
a locking pin cylinder within the frame configured to receive the locking pin piston.

11. The frame assembly of claim 10, further comprising a pressurized gas system in fluid communication with the locking pin cylinder, wherein the pressurized gas system is configured to move the locking pin from the inward position to an outward position when pressurized gas is introduced.

12. The frame assembly of claim 11, wherein the locking pin piston is configured to prevent the operating assembly from being removed from the frame when pressurized.

13. The frame assembly of claim 8, wherein the locking pin is configured to engage with a circumferential groove in the operating assembly when in the outward position.

14. The frame assembly of claim 13, including an O-ring carried by the locking pin assembly.

15. A pressurized paintball gun system comprising:
a frame;
an operating assembly at least partially slidably received in the frame and having a locking pin receptacle;
a trigger valve assembly within the frame;
a locking pin received in the frame;
a locking pin piston included in the locking pin;
a pressurized gas system in fluid communication with the locking pin, wherein introduction of pressurized gas to the pressurized gas system causes the locking pin to extend from the frame into the locking pin receptacle of the operating assembly; and
wherein the locking pin piston, when in a biased inward position, prevents the flow of pressurized gas through the trigger valve assembly to the operating assembly.

16. The pressurized paintball gun system of claim 15, further comprising a spring biasing the locking pin towards a retracted position within the frame.

17. The pressurized paintball gun system of claim 16, further comprising:

a locking pin piston attached to the locking pin; and a locking pin cylinder within the frame configured to receive the locking pin piston.

18. The pressurized paintball gun system of claim 17, wherein the pressurized gas system is in fluid communication with the locking pin cylinder, and wherein introduction of pressurized gas into the locking pin cylinder causes the locking pin to extend from the frame.

19. The pressurized paintball gun system of claim 18, wherein the locking pin piston is configured to prevent removal of the operating assembly when pressurized.

20. The pressurized paintball gun system of claim 15, wherein the locking pin receptacle comprises a circumferential groove extending around an outer surface of the operating assembly, and wherein the locking pin engages with the circumferential groove when extended from the frame.

* * * * *